US009222045B2

(12) United States Patent
Lindblom et al.

(10) Patent No.: US 9,222,045 B2
(45) Date of Patent: Dec. 29, 2015

(54) METHOD FOR PRODUCING A STABLE BORIC SOLUTION

(75) Inventors: Tommy Lindblom, Stockholm (SE); Magnus Undén, Stockholm (SE)

(73) Assignee: Triboron International AB, Jordbro (SE)

( * ) Notice: Subject to any disclaimer, the term of this patent is extended or adjusted under 35 U.S.C. 154(b) by 974 days.

(21) Appl. No.: 13/319,376

(22) PCT Filed: May 10, 2010

(86) PCT No.: PCT/SE2010/050510

§ 371 (c)(1),
(2), (4) Date: Jan. 24, 2012

(87) PCT Pub. No.: WO2010/134872

PCT Pub. Date: Nov. 25, 2010

(65) Prior Publication Data

US 2012/0108475 A1 May 3, 2012

(30) Foreign Application Priority Data

May 8, 2009 (SE) ..... 0950323

(51) Int. Cl.
*C10M 173/02* (2006.01)
*C10L 1/12* (2006.01)
(Continued)

(52) U.S. Cl.
CPC ..... *C10L 1/1291* (2013.01); *C10L 10/08* (2013.01); *C10M 125/26* (2013.01); *C10M 2201/087* (2013.01); *C10N 2230/02* (2013.01); *C10N 2270/00* (2013.01)

(58) Field of Classification Search
CPC ..... C10M 2201/087; C10N 2210/02
USPC ..... 508/156
See application file for complete search history.

(56) References Cited

U.S. PATENT DOCUMENTS

2007/0037714 A1 2/2007 Olliges

FOREIGN PATENT DOCUMENTS

CN 1729277 A 2/2006
JP 2001-234189 8/2001
(Continued)

OTHER PUBLICATIONS

Office Action for corresponding Japanese patent application 201080025405.0; Japanese registration No. 2013022800848430 dated Mar. 5, 2013.
(Continued)

*Primary Examiner* — Vishal Vasisth
(74) *Attorney, Agent, or Firm* — Renner, Otto, Boisselle & Sklar, LLP

(57) ABSTRACT

The invention relates to a method for producing a stable boron solution with lubricating characteristics which is intended to be used preferably as an addition in the form of a concentrate/additive to a liquid, e.g. to a liquid fuel or a lubricant. The invention is achieved by the method steps of using a boron substance of pharmaceutical quality (1, 11), using a liquid as solvent, applying a mixing ratio between the boron substance and the solvent (3, 13) of preferably 1 g of boron per 15-25 liters of liquid, agitating the mixture for an initial predetermined period of time (4, 14), adding further liquid to dilute the solution (6, 15), the quantity of liquid being chosen such that a final user mixture reaches a concentration of between 20 and 30 ppm of boron (8), and further agitating the mixture (7, 16) for a second predetermined period of time so that the boron substance is completely dissolved in the boron solution, resulting in a boron solution which is stable over time.

8 Claims, 4 Drawing Sheets

(51) Int. Cl.
*C10L 10/08* (2006.01)
*C10M 125/26* (2006.01)

(56) References Cited

FOREIGN PATENT DOCUMENTS

| | | |
|---|---|---|
| JP | 2003-520890 | 7/2003 |
| JP | 2005-538209 | 12/2005 |
| JP | 2009-504839 | 2/2009 |
| JP | 2009-504840 | 2/2009 |
| WO | 01/53435 A2 | 7/2001 |
| WO | 2004/022676 | 3/2004 |
| WO | 2004/022676 A1 | 3/2004 |
| WO | 2007/021364 A1 | 2/2007 |

OTHER PUBLICATIONS

International Search Report for corresponding patent application PCT/SE2010/050510 dated Jul. 16, 2010.
Smith, R.A. "Boric Oxide, Boric Acid, and Borates". 2005, Tables 3 and 4.
Office Action for corresponding Japanese patent application 2012-509768 dated Aug. 25, 2014 and English translation.

METHOD FOR PRODUCING A STABLE BORIC SOLUTION

This application is a 371 of PCT/SE2010/050510, filed May 10, 2010.

TECHNICAL FIELD

The present invention relates to a method for producing a solution with lubricating characteristics. The invention relates particularly to a method for producing a solution with lubricating characteristics which contains boron and is preferably intended to be used as an addition to a fuel or to a lubricant. The invention relates more particularly to producing a stable concentrate of dissolved boron which, when used in, for example, a machine or engine, results in increased lubrication and reduced friction, reduced risk of corrosion and reduced wear. The invention comprises also the boron solution produced according to the method, and use of such a boron solution.

TECHNICAL BACKGROUND

Various types of lubricant are used inter alia wherever machine parts or engine parts are used. The better the lubricant characteristics, the smaller the amount of energy consumed in running the machines and the smaller the amount of wear on constituent parts. It has for many years been known that the basic substance boron has very good friction-reducing characteristics. Empirical tests show that significant fuel savings can be made by incorporating boron in lubricants and fuels, especially if the particle sizes of the boron substance are within the range 0.5-100 nanometers. The advantageous lubricant effect is due to the ability of boron to establish complex ligand bonds to metals, thereby forming multi-dimensional plates between which the Van de Waals forces are weak and which therefore easily slide relative to one another. The boron substance forms a self-repairing system in that new bonds to the metal continually replace worn-away material. In addition, borate ions constitute, owing to their electronegativity, an effective reducing agent which counteracts or prevents corrosion.

Many attempts have been made to dissolve boron in various liquids and lubricants. A problem has been to produce a water-based boron solution in which the boron substance in desired particle sizes and concentrations is completely dissolved in the liquid and remains dissolved over time, such that the boron substance does not precipitate and render the liquid turbid or settle out on the bottom of the container in which the liquid/solution is placed. Incorporating boron in a fuel or a lubricant by adding a boron substance/compound is therefore prior art. Various methods have also been patented.

U.S. Pat. No. 6,368,369 (Advanced Lubrication Technology) describes for example a method for mixing boric acid with, for example, engine fuels to achieve friction-reducing characteristics. This involves mixing the boric acid with a base oil and endeavouring to ensure that the particle sizes of the boron are between 0.5 and 20 micrometers, which is for example achieved by so-called jet milling.

U.S. Pat. No. 6,783,561 (Foley & Lardner) refers inter alia to a method whereby boron is added to and is in a "known way" mixed with a fuel or a lubricant in a concentration of 30-3000 ppm. There is no further indication as to how the actual mixing is done.

SE524898 (Eagle Water Ltd) describes a procedure for producing a boron solution in the form of a concentrate intended for mixing with a liquid, e.g. a liquid fuel. The method amounts to mixing a boron compound with a solvent and stirring and/or shaking the resulting mixture, possibly by means of a mechanical finely-dividing element and possibly at elevated temperature. The boron content may be up to 250,000 ppm but is preferably within the range 10-1000 ppm. The mixing method is not described in detail.

Prior art thus indicates that boron is in a "known way" mixed with a solvent, but does not indicate in more detail how to achieve a solution with completely dissolved boron substance and in which the boron substance remains completely dissolved, resulting in a solution which is stable over time. There is for example no indication of the initial boron substance or grade or how it is treated/incorporated in order to be completely dissolved in the liquid and remain stably dissolved over time. Further studies have found that boron solutions produced by these known methods do not remain stable over time, which is a significant and possibly crucial problem with regard to being able to sell the solutions on the market. It has thus been found that the boron particles in the solutions do not become stably dissolved but readily aggregate and over time gradually precipitate, resulting inter alia in the liquid becoming turbid. The boron particles also settle out progressively on the bottom of the container in which the solution is placed, which may for example be the oil pan of a vehicle. The decreasing boron content of the liquid greatly reduces the desired and intended lubricating characteristics of the solution, and the concentrated precipitation of boron may even cause damage to engines and machines. For example, if precipitated boron in concentrated form enters, for example, an engine, it will form undesirable hard and harmful deposits throughout the engine, e.g. on pistons, on exhaust valves, in pumps, in filters and on or in other vital parts of the engine.

Prior art within this field thus does not indicate how to solve the problem of achieving a boron solution which in desired particle sizes and concentrations is non-turbid and stable over time.

SUMMARY OF THE INVENTION

An object of the invention is to solve the above problem and propose a method of the kind indicated in the introduction which achieves a solution of boron in desired particle sizes and concentrations, whereby the boron substance is completely dissolved in the liquid and the resulting boron solution remains stable over time and, when used for example in a machine or engine, results in increased lubrication, reduced friction, reduced risk of corrosion and reduced wear on constituent mechanical parts.

Another object of the invention is to propose a method which is easy and inexpensive to make and hence to procure and use.

These and further objects and advantages are achieved according to the invention with a method according to the features indicated in the characterising part of claim 1.

The present invention thus relates to a method for producing a boron solution with good lubricating characteristics which is intended primarily to be used as an addition to a fuel or a lubricant. The method involves boron powder of a specific grade being mixed with a solvent in a number of steps and in a certain mix ratio. The mixture undergoes mechanical agitation in at least two steps between which further liquid, solvent, is added, during which agitation the temperature of the mixture may be allowed to rise.

Further features and advantages, of the invention are indicated by the more detailed description of the invention set out below and the accompanying drawings and other claims.

BRIEF LIST OF DRAWINGS

The invention is described in more detail below in various preferred embodiments with reference to the attached drawings.

DESCRIPTION OF PREFERRED EMBODIMENTS

Figure 1:
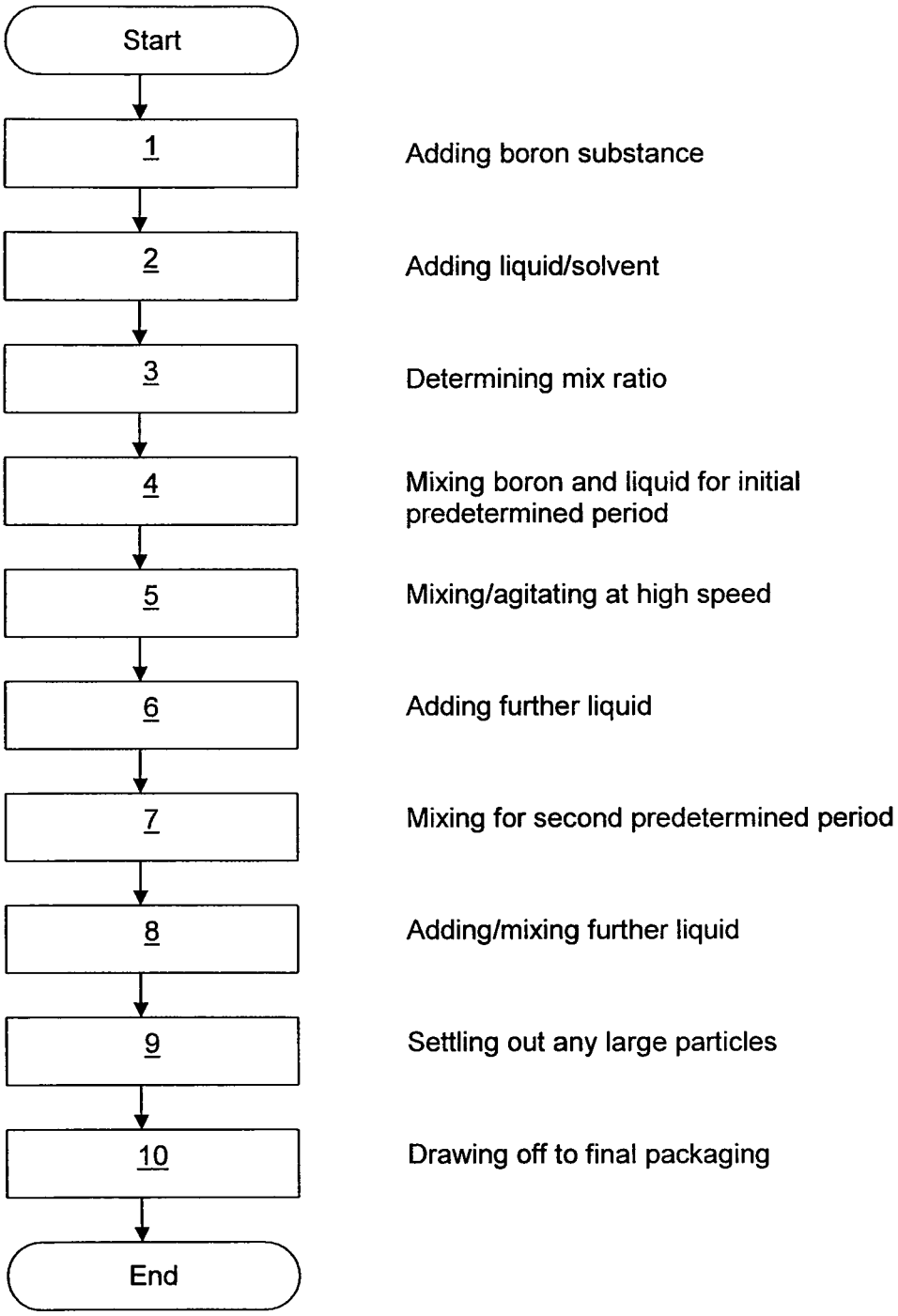
FIG. 1 is a flowchart illustrating the method steps according to the invention which lead to a boron solution which is non-turbid and stable.
Figure 2:
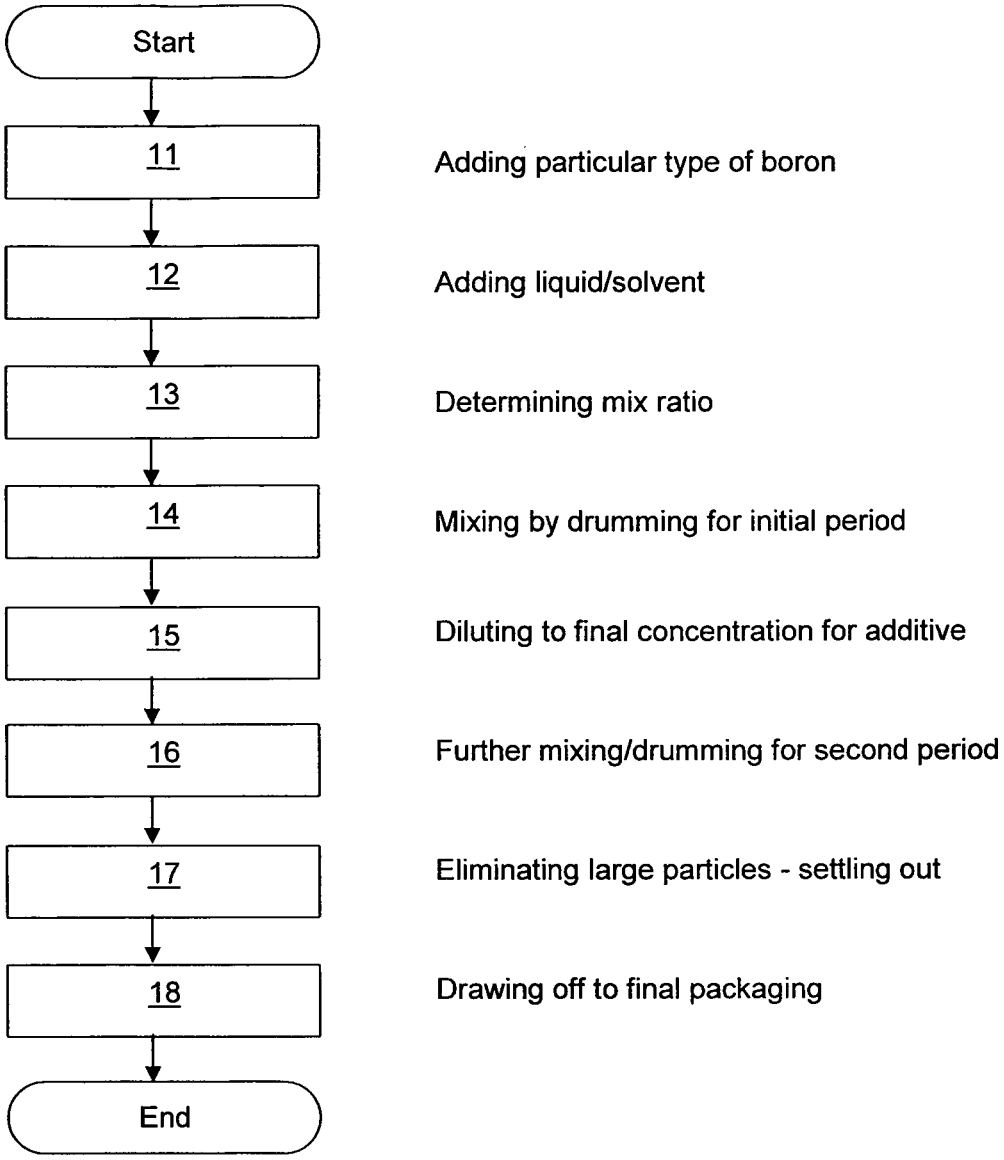
FIG. 2 is a further flowchart illustrating an alternative method for achieving a stable boron solution.

The present invention thus relates to a method whereby boron, e.g. in the form of a boron compound, is added to and finely divided/dissolved in a liquid in such a way as to cause the boron substance to remain stably dissolved in the liquid over time.

It is for example possible to use a boron compound such as a crystalline boric acid, boron oxide, boron trioxide etc. It is preferable to use an oxygen-bearing boron compound $H_3BO_3$ in the form of a powder, which is therefore a white crystalline boric acid of pharmaceutical quality, i.e. with a purity of preferably at least 99% and a molecular weight of 61.8 g/mol. An alternative is to use boron oxide $B_2O_3$, with a molecular weight of 69.6 g/mol, also known as anhydrous boric acid, which does not contain water. Boron oxide is therefore boric acid without water content and is usable in the same way as boric acid. Boron oxide is converted spontaneously to boric acid by water, e.g. by condensate.

The liquid with which the boron substance or the boron powder is to be mixed is preferably an organic and/or inorganic liquid or a gas. Examples of such liquids are kerosene, naphtha, water, vegetable/synthetic/fossil oils, alcohol. Examples of suitable gases are methane, hydrogen etc. The amount of liquid may be in small batches, e.g. of about 3 liters, but may also be, for example, about 1000 liters per batch.

It is important to use/achieve boron particles which are of small particle size. The boron particles used as initial material from the outset range from 1 millimeter to 10 micrometers in size.

It is also advantageous that negative electrostatic charging of the boron particles be achieved during the mixing. If an alcohol is chosen as solvent, its hydrogen bonds will counteract the electronegativity of the boron compound and hence the latter's inherent tendency to covalent bonding. The boron particles may be given a negative electrostatic charge by vigorous stirring, e.g. by means of mixer blades or the like, in which case the blades may preferably have a wing profile and be twisted and provided with winglets.

The Mixer Method

In this method, the mixing of the boron substance and the liquid comprises two main steps, in at least one of which a mixer is used. The configuration of the mixer blades needs to be such that there are major pressure differences between their upper and lower sides. Their profile needs a blunt forward edge and a sharper rear edge and the blade setting needs to be between 0.5 and about 3 degrees, preferably about 2 degrees. The setting is adapted to achieving a more uniform angle of incidence across the surface, since the blade profile moves at different velocities through the liquid, depending on how far away from the centerline the blade meets the liquid and the particles mixed with it. The most suitable blades have a profile which allows laminar flow across and past the thickest part of the profile chord, i.e. where the profile is more than 20% of the chord, as measured from the forward edge of the profile. The sharper termination of the profile causes the liquid and its particles to be brought together/mixed at different velocities. Suitable blade profiles available on the market may be Clark Y™, NACA-6™ series or SG6042™. It is important that the profile has a low Reynolds number and that the thickness is about 12% of the chord. The nature of the flow is of course affected by the viscosity of the liquid. The time taken to achieve the desired final result will depend on the blade configuration. The very finest boron particles are obtained by mutual abrasion and collision with other boron particles in the liquid. Such collisions take place largely at the rear edge of the blade where the liquid/the particles meet at high velocities.

A step for achieving a stable boron solution is to use a boron substance with certain specific characteristics, method step 1. The choice of the boron substance greatly affects the final result. The boron substance which meets the requirements of this method is Borax $H_3BO_3$ in powder form and of pharmaceutical quality, i.e. a boron substance with a purity of preferably at least 99% and a molecular weight of 69.6. Boron oxide $B_2O_3$, also known as anhydrous boric acid, which is a water-free boric acid, is also usable.

A further step is to choose a liquid or solvent in which the boron substance or the boron powder is to be incorporated, method step 2. This liquid is preferably an organic and/or inorganic liquid or a gas. Examples of conceivable liquids are kerosene, naphtha, water, vegetable/synthetic/fossil oils, alcohols, and examples of conceivable gases are methane, hydrogen etc.

A further step is to use a predetermined mix ratio between the boron powder and the liquid, method step 3. This is a crucial factor for achieving the product according to the invention. The mix ratio needs to be about 1 to 25 by weight, i.e. mixing about 4 parts of boron with 100 parts of liquid/solvent. The ratio may of course vary somewhat, e.g. depending on the temperature of the solution at the time of mixing, but also on what the solution is ultimately intended for. If the solution is intended for application in diesel fuel, a mix ratio of about 1/1000 is employed.

The next step is to mix the components, method step 4, with one another and treat the mixture/solution mechanically, e.g. in a mixer provided with blades. The mixer agitates the mixture at high speed, i.e. about 15,000 rpm, for an initial predetermined period of 15-20 minutes, resulting in an initial solution, method step 5. The temperature of the solution may rise at this stage but must never exceed the breakdown point of the solvent, e.g. oil. The initial mixing thus takes place in liquid of low viscosity mainly involving uncharged particles and resulting in boron particles in micrometer sizes. The mixing takes place at a blade periphery velocity of about 800 km/h for 15-20 minutes and generates a temperature rise from normal room temperature of 20 degrees to about 50-60° C. The mixing takes place with advantage at atmospheric pressure. Thereafter, further liquid, e.g. an oil, is added, method step 6.

The next step is to run the mixer for a second predetermined period of about a further 15 minutes, method step 7. The temperature of the solution is allowed to rise but not to reach the breakdown temperature of the liquid. If oil is used, the temperature should not exceed 80° C. This second mixing, which leads to the final product, thus takes place in liquid of higher viscosity and generates particles of nano size and also charges the particles electrically. The mixing takes place at a periphery velocity of about 800 km/h and proceeds for 30-40 minutes, generating during that time a temperature rise to about 70-80° C. The mixing takes place at atmospheric pressure. The periphery velocity of the blades should be between 500 and 800 km/h. Lower velocities result in longer mixing times and greater attraction forces between particles, with consequently more settling out and clustering of the final product.

The temperature of the liquid at the commencement of mixing may be between −25° C. and +75°. The initial temperature has little effect on the final result and/or on the mixing time.

The temperature rises during the mixing because of the kinetic energy developed. At 170° C. boric acid begins to form crystals, thereby disrupting the solution. As previously mentioned, the temperature reached on completion of mixing should not exceed 80° C.

Thereafter, further liquid is added, method step 8, and the solution is further mixed for, say, 10-15 minutes. The amount of liquid incorporated in the solution is such that a final user mixture, i.e. that resulting from the final customer incorporating the additive in a desired engine fuel, exhibits a concentration of about 20-30 ppm in the user mixture (e.g. the engine fuel).

After particles larger than 100 nanometers have had the opportunity to settle out, method step 9, the final product is drawn off into a suitable container, method step 10.

The Tumbling Method

A first step for achieving a stable boron solution with this method is to use a boron substance with specific characteristics, method step 11. The choice of the boron substance greatly affects the final result. The boron compound may for example consist of crystalline boric acid, boron oxide, boron trioxide etc. It is preferable to use an oxygen-bearing boron compound $H_3BO_3$ in the form of a powder, which is therefore a white crystalline boric acid of pharmaceutical quality, i.e. with a purity of preferably at least 99% and a molecular weight of 61.8 g/mol. An alternative is to use boron oxide $B_2O_3$, with a molecular weight of 69.6 g/mol, also known as anhydrous boric acid, which does not contain water. Boron oxide is boric acid without water content and is usable in the same way as boric acid. Boron oxide is converted spontaneously to boric acid by water, e.g. by condensate.

The next step is to choose and use liquid/solvent in which the boron substance or the boron powder is to be incorporated, method step 12. In this case, alcohol with a percentage by volume of at least 95%, preferably 99.5% or higher, is chosen. The liquid may also be an organic and/or inorganic liquid or gas. Examples of conceivable liquids are kerosene, naphtha, water, vegetable/synthetic/fossil oils. Examples of conceivable gases are methane, hydrogen etc.

The next step is to apply a certain mix ratio which in this method is chosen such that between 0 and 300 g of boron substance, preferably about 20-30 g, is used per liter of liquid, method step 13. The mix ratio depends on the final purpose for which the mixture is to be used. The higher concentration is intended for additives for oils which are not consumed in, for example, an engine or for chains etc., whereas the lower mix ratio is employed for oils/fuels which are consumed, e.g. two-stroke oil/fuel.

The next step is to tumble the mixture, i.e. placing it in a rotating drum which is provided with internal paddles or contains steel balls or similar mixing means and is rotated at a speed appropriate to the purpose, e.g. 2-10 rpm, for an initial predetermined period of preferably 8-10 hours, method step 14. The tumbling procedure is preferably conducted at room temperature but may of course also be conducted at other temperatures, e.g. at elevated temperature.

Thereafter, further liquid, diluent, is added, method step 15, in such quantity that a final user mixture arrived at by the final customer incorporating the additive according to mixing instructions in the respective engine fuel exhibits a concentration of about 20-30 ppm. This step is followed by further mixing for a second predetermined period, method step 16.

Boron particles which are of too large a particle size, i.e. those larger than 100 nm, are thereafter separated, e.g. by settling out, method step 17.

Thereafter the solution, the final product/the additive, is drawn off into suitable containers, e.g. plastic bottles, method step 18. The final customer will subsequently add the additive to the respective engine fuel, according to mixing instructions, preferably in a proportion of 1 to 1000, resulting in a final boron concentration in the engine fuel of preferably about 20-30 ppm.

The boron substance is thus incorporated in, for example, a base liquid, thereby creating a concentrate or additive which, for the purposes of use, is diluted in a further liquid, preferably in a propellant such as petrol in various forms, e.g. alkylate, avgas 100LL, avgas 91/96, possibly with incorporation of various alcohols, methanes etc. The propellant may also be diesel fuel in various forms, e.g. diesel oil, synthetic diesel fuel, RME, REE, FT diesel fuel, kerosenes, naphthas, etc. The further liquid may also be water in various forms, e.g. vapour, or vegetable/synthetic/fossil oils. Various gases are also conceivable, e.g. hydrogen gas, liquid hydrogen etc.

The boron content of the concentrate/the additive may for example be up to 250,000 ppm or more. The finished fuel mixture, after adding the additive, should reach a boron content within the range 10-10,000 ppm, preferably within the range 20-30 ppm. The higher concentration, up to 10,000 ppm, pertains primarily to use in pure lubricants.

The boron solution according to the invention may with advantage also be used in, for example, rust-protecting/lubricating sprays or food industry applications and need not be protection-classified. The boron solution is also usable as mould oil, e.g. in concreting with sliding formwork, or as cutting fluid, in which the boron compound will also have an antibacterial effect. The solution may also serve as an oil-free lubricant for the metal pressing industry, making it possible to eliminate oil recovery after the pressing process.

The solution/the additive may of course also be used directly or indirectly as a lubricating agent in organic and/or inorganic liquids and gases, it may also reduce the amount of expensive and environmentally more pollutant products.

Use in vehicle fuels achieves further advantages in that pumps, injection nozzles, etc. are more effectively lubricated.

Figure 3:
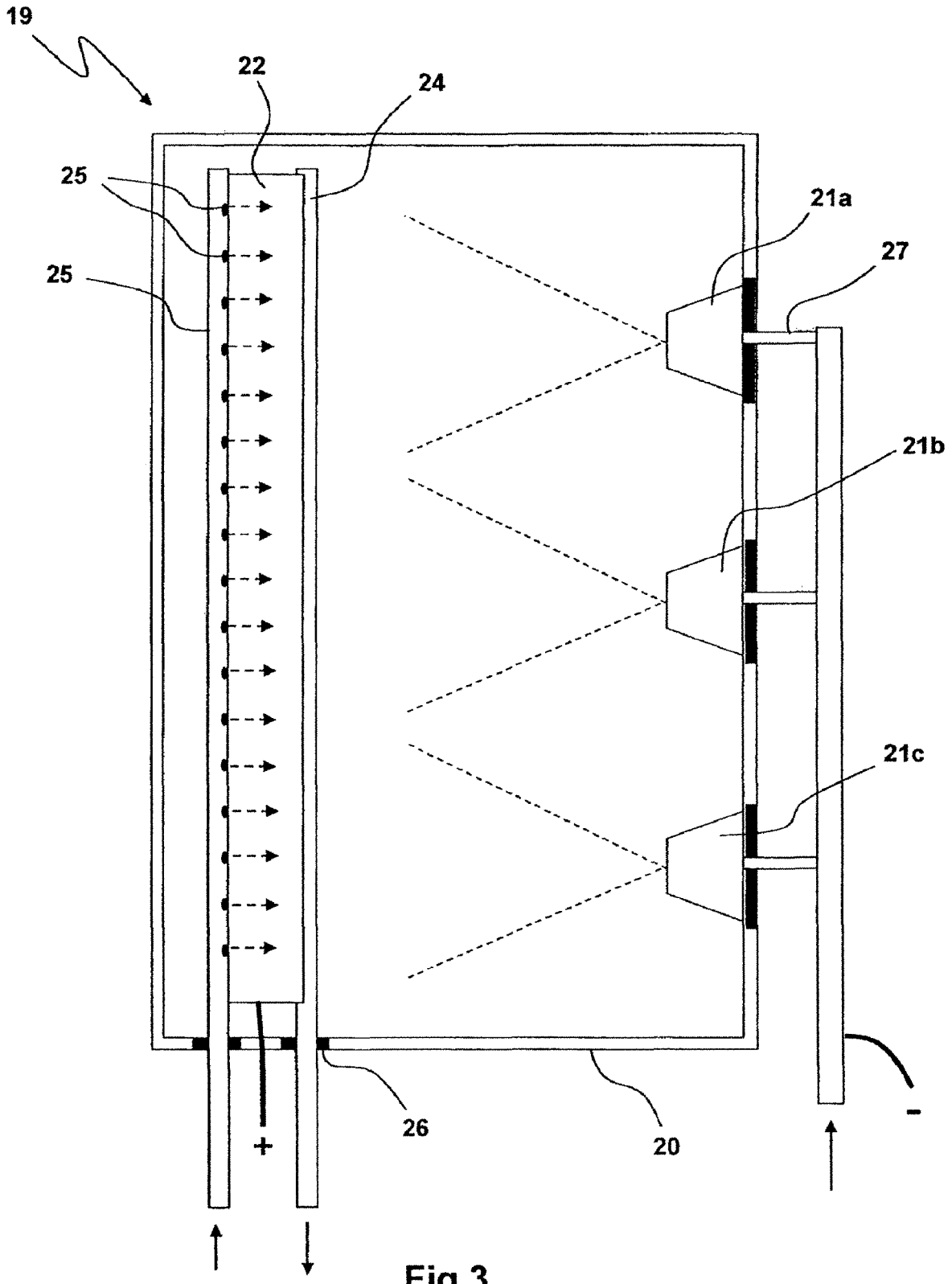
FIG. 3 depicts from above a device for treating any desired liquid with a boron substance.

FIG. 3 depicts from above a device 19 for treatment of a liquid with a boron substance. A plurality of spray nozzles 21*a-c*, a metal plate 22, a supply pipe 23 and a gathering channel 24 are disposed in a substantially closed treatment chamber 20. A boron solution under pressure is supplied to the treatment chamber 20 via the spray nozzles 21*a-c* in such a way that the boron solution is sprayed at the liquid. The spray nozzles 21*a-c* are therefore directed towards the metal plate 22. Untreated liquid, e.g. oil, is supplied to the treatment chamber 20 and the metal plate 22 via the supply pipe 23 and is distributed via holes 25 in the supply pipe 23. The oil or liquid is distributed evenly across and runs down the sloping metal plate 22 towards the gathering channel 24. The pressure of the incoming oil or liquid and the angle of the sloping metal plate 22 affect the flow velocity and therefore the time of exposure to spray from the spray nozzles 21*a-c*. The device may be used for various different types of liquids.

The metal plate 22 is connected by an electrical conductor to a voltage source and is preferably supplied with a positive voltage potential, whereas the spray nozzles 21*a-c* are connected to the negative potential of the voltage source. The voltage level may be adjusted to a voltage appropriate to the purpose. This electrostatic method and spray device make it possible to achieve more effective incorporation of the boron substance in the liquid.

The voltage potential may also be reversed, in which case the metal plate 22 becomes negative and the spray nozzles 21*a-c* positive.

The pressure of the boron solution supplied to the spray nozzles 21*a-c* is adjustable, as also the amount of boron dissolved in the solvent. The gathering channel 24 evacuates treated liquid, e.g. oil, to an external gathering vessel (not depicted). The treatment chamber 20 is with advantage subjected to positive pressure which is adjusted by means of a valve (not depicted) so that the finished oil mixture exhibits a correct flow velocity. The metal plate 22 is insulated from the treatment chamber 20 by insulators 26. The spray nozzles 21*a-c* are connected by hoses or pipes 27 to an external pressurised container (not depicted) which contains the solvent, the boric acid.

Figure 4:
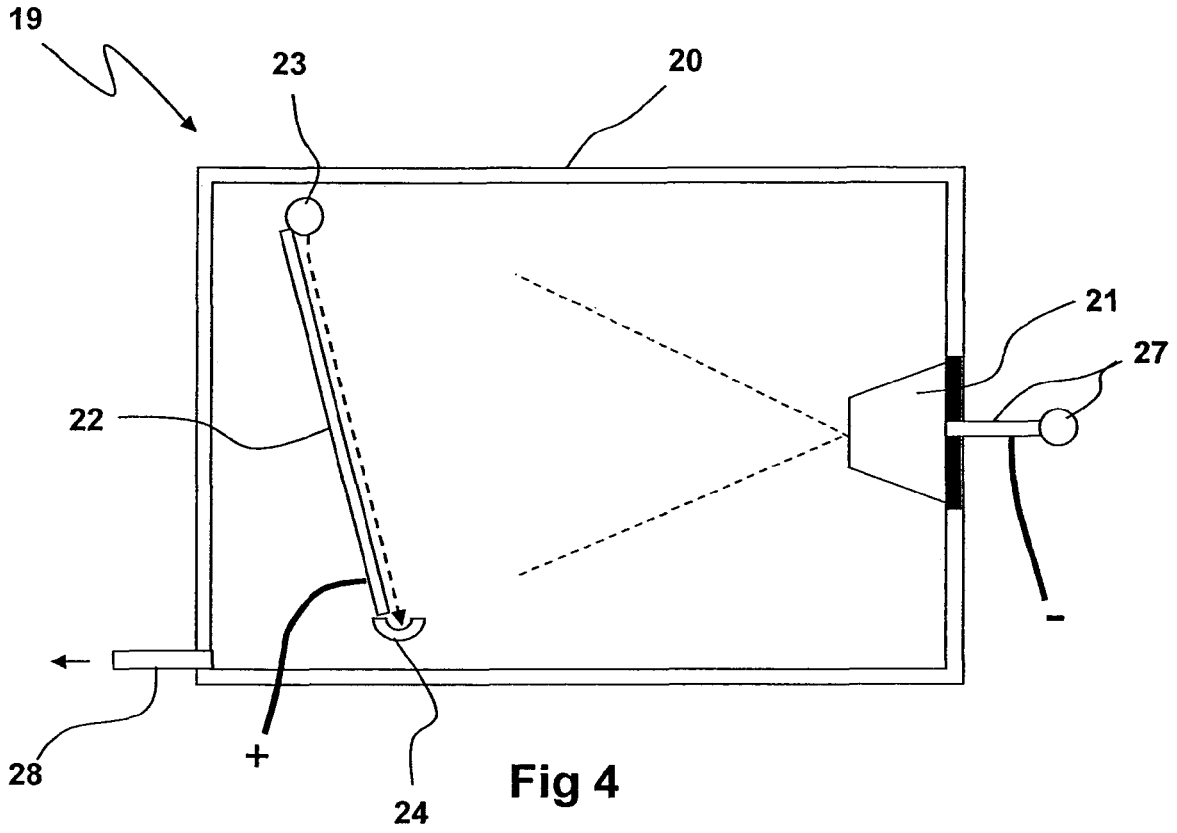
FIG. 4 depicts the device in FIG. 3 but as seen from the side.

FIG. 4 depicts the device in FIG. 3, but as seen from the side. It shows clearly how the metal plate 22 slopes relative to the mixing chamber 20. An evacuation pipe 28 is provided to intercept and recover surplus boron mixture.

The above description is primarily intended to facilitate comprehension of the invention. The invention is of course not limited to the embodiments indicated, since other variants of it are also possible and conceivable within the scope of the concept of the invention and within the scope of protection of the claims set out below. Thus the boron solution/the additive may also be suitably applied directly to whatever is to be lubricated, without being first mixed with some other liquid such as a propellant or lubricant.

The invention claimed is:

1. A method for producing a stable boron solution with lubricating characteristics which is intended to be used preferably as an addition in the form of a concentrate/additive to a liquid, the method comprising the steps of using a boron substance of pharmaceutical quality with a purity of at least 99%, using a solvent comprising alcohol, kerosene, naphtha, water, vegetable/synthetic/fossil oils, methane, or hydrogen, applying a mixing ratio between the boron substance and the solvent of preferably 1 g of boron per 15-25 liters of solvent to form a mixture, agitating the mixture using a mechanical mixer at a speed of about 15,000 rpm, the agitating resulting in boron particles in micrometer size and the agitating generating a temperature rise of the solution that does not exceed the breakdown temperatures of the solvent, adding further liquid to dilute the mixture, the quantity of liquid being chosen such that a final user mixture reaches a concentration of between 20 and 30 ppm of boron, and further agitating the mixture so that the boron substance is completely dissolved in the boron solution, resulting in a boron solution which is stable over time.

2. A method according to claim 1, wherein the further agitating the mixture generates a temperature rise that does not reach the breakdown temperature of the liquid.

3. A method according to claim 1, wherein the boron substance is in powder form.

4. A method according to claim 1, wherein the boron substance comprises Borax $H_3BO_3$.

5. A method according to claim 1, wherein the boron substance comprises boron oxide $B_2O_3$.

6. A method according to claim 1, wherein the liquid is a liquid fuel or a lubricant.

7. A method according to claim 1, wherein the agitating comprises mixing the mixture using a blade periphery velocity of about 800 km/h.

8. A method according to claim 1, wherein the agitating comprises mixing for a time of 15-20 minutes, and the agitating generates a temperature rise from about 20° C. to about 50-60° C.

* * * * *